United States Patent [19]

Hauser

[11] Patent Number: 4,697,914

[45] Date of Patent: Oct. 6, 1987

[54] TONER CONTAINMENT METHOD AND APPARATUS

[75] Inventor: Oscar G. Hauser, Rochester, N.Y.

[73] Assignee: Xerox Corporation, Stamford, Conn.

[21] Appl. No.: 393,892

[22] Filed: Jun. 30, 1982

[51] Int. Cl.[4] ..... G03G 15/08; G03G 13/08

[52] U.S. Cl. ..... 355/3 DD; 118/653

[58] Field of Search ..... 355/3 DD, 15, 3 R; 118/653, 654, 655, 656, 657, 658, 652

[56] References Cited

U.S. PATENT DOCUMENTS

| | | | |
|---|---|---|---|
| 3,611,992 | 10/1971 | Lyles et al. | 118/637 |
| 3,651,784 | 3/1972 | Hewitt | 118/636 |
| 3,926,516 | 12/1975 | Whited | 355/3 DD |
| 3,937,570 | 2/1976 | Hudson | 355/3 DD |
| 3,991,713 | 11/1976 | Whited | 118/637 |
| 4,213,617 | 7/1980 | Salger | 277/12 |

FOREIGN PATENT DOCUMENTS

| | | | |
|---|---|---|---|
| 0041449 | 3/1980 | Japan | 355/3 DD |

*Primary Examiner*—R. L. Moses

[57] ABSTRACT

Apparatus and method for reducing toner contamination in an electrostatographic reproducing machine are described wherein at at least one housing which performs an operation on an imaging surface bearing an electrostatic latent image involving charged toner particles has at least one electrode extending across the width of and spaced from the imaging surface at at least one exit portion through which air normally flows from the housing to other portions of the machine, the electrode being electrically biased to a polarity and magnitude selected relative to the charge on the imaging surface to create an electric field barrier in the exit portion sufficient to repel the charged particles in the exiting air back into the principal portion of the housing substantially without restricting the air flow from the exit portion. In a preferred embodiment the electrode is positioned substantially parallel to the imaging surface. This electrostatic seal arrangement may be used in development or cleaning housings and a preferred mode is used in a magnetic brush development housing at the imaging surface entrance portion where the magnetic brush moves in a direction counter to the direction of the imaging surface.

1 Claim, 7 Drawing Figures

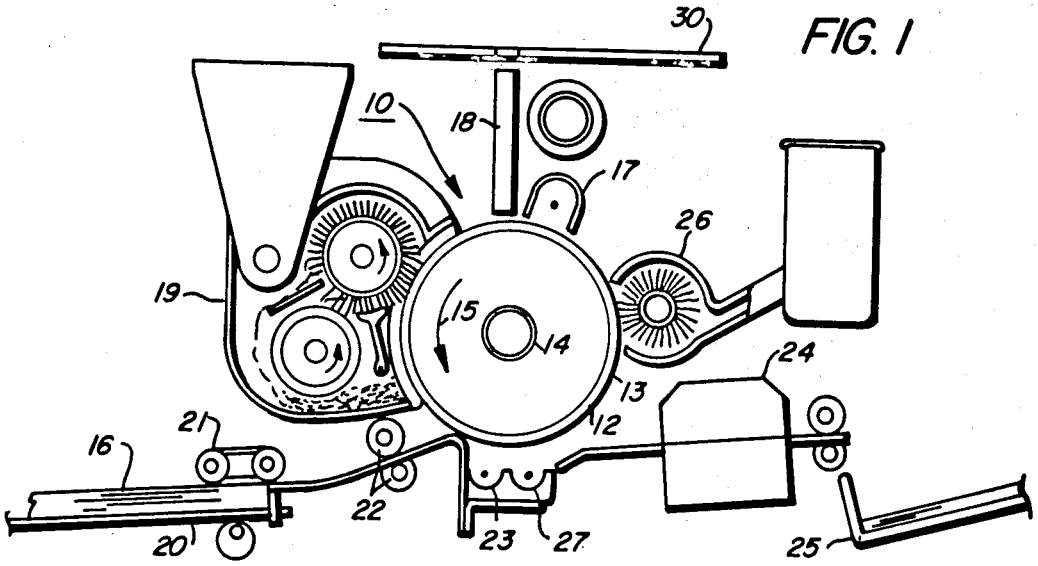
FIG. 1
FIG. 5
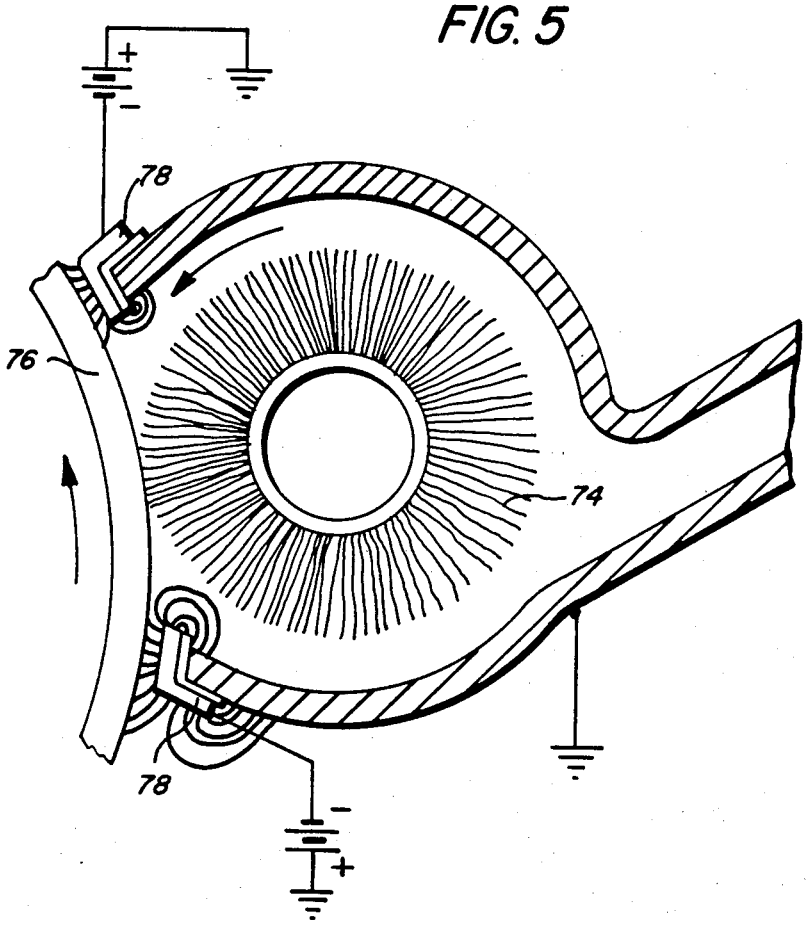

TONER CONTAINMENT METHOD AND APPARATUS

REFERENCE TO COPENDING APPLICATION

Reference is hereby made to copending application Ser. No. 279,415 entitled "Charged Particle Containment Apparatus" filed July 1, 1981 in the name of Michael R. Stanley. Reference is also made to copending appli cation Ser. No. 06/393,900 filed concurrently herewith in the name of Michael A. Parisi and entitled "Electrostatographic Reproducing Apparatus with Spring Loaded Paper Path ", now U.S. Pat. No. 4,452,524.

BACKGROUND OF THE INVENTION

This invention relates to electrostatographic reproducing apparatus and more particularly to a method and apparatus for reducing the contamination of the reproducing apparatus by charged toner particles escaping from a housing in which they are contained.

In the electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with a developing powder, referred to in the art as toner. Most development systems employ a developer material which comprises both charged carrier particles and charged toner particles which triboelectrically adhere to the carrier particles. During development, the toner particles are attracted from the carrier particles by the charge pattern of the image areas on the photoconductive insulating area to form a powder image on the photoconductive area. This iamge may subsequently be transferred to a support surface such as a copy paper to which it may be permanently affixed by heating or by the application of pressure. Following transfer of the toner image to the support surface, the photoconductive insulating surface is cleaned of residual toner to prepare it for the next imaging cycle.

One of the problems associated with electrostatographic reproducing apparatus is the contamination of the various processing stations by charged toner particles. This happens frequently as the charged toner particles may escape from the developer housing or the cleaner housing and float throughout the reproducing machine. These particles may be attracted to critical surfaces of the various processing stations, resulting in contamination and degradation of the performance of that subsystem. To maintain copy quality it is essential that the elements of the automatic reproducing machines remain substantially free from contaminating particles. One of the areas which is most sensitive to contamination is the optical system. If toner is allowed to collect on a lens or a mirror, for example, the total exposure is dramaticallly decreased and a problem with background may be created. Furthermore, if toner contamination is allowed with regard to the illuminating lamps, the lamp intensity goes down which also reduces the exposure. In addition, the same difficulty with regard to increased background may be had if toner is allowed to collect on the viewing platen. All these difficulties associated with toner collecting within the optical cavity provide for non-uniform exposure, increased background, and generally unacceptable copy quality, resulting in the need for unscheduled maintenance by a skilled technician. While the principal area that can be contaminated by loose, charged particles is the optical arrangement, it should be noted that such charged particles may interfer with other operations in an automatic reproducing machine. For example, if toner particles collect on the corona wires, streaking in the final copy can be created as a result of non-uniform charging.

Generally, the development system and the cleaning system have geometrical seals between the developer and the cleaner housing, and the photoconductive insulating member to prevent leakage of toner particles therefrom. In addition or alternatively thereto, the developer housing may be maintained at a negative pressure to insure that air flow is in an inwardly direction rather than an outwardly direction from the chamber storing carrier particles and toner particles. In these systems, typically a filter is used through which the air is pulled. With continued usage, the filter tends to clog up and the flow of air is reduced. Furthermore, such negative pressure devices are expensive and require additional space for the ducting within the automatic reproducing machine. In addition, it is generally observed that even with the foregoing precautions, toner particles tend to escape from within the developer housing. It has also been proposed to provide a toner material which contains a magnetic component for magnetic brush development system wherein the toner will be held onto the carrier, and thus not become airborne and go outside the developer housing and contaminate the machine.

PRIOR ART

U.S. Pat. No. 3,926,516 (Whited) and U.S. Pat. No. 3,991,713 (Whited) describe development apparatus for an electrostatographic printing machine which takes advantage of the powder cloud created in the magnetic brush development system, and extends the development zone, both top and bottom, to obtain better development. A bias is placed on the development electrode to the same polarity and to a magnitude above the background and below the image area so that the background does not develop out and the image area is developed.

U.S. application Ser. No. 279,415, referred to above which is commonly assigned to the Assignee of the present invention, describes a system for reducing the scattering of charged particles from a housing by providing an electrode biased to a level intermediate the image potential and the non-image areas of the imaging surface or the electrode but not to the non-image areas. Periodically the electrode is withdrawn and cleaned.

SUMMARY OF THE INVENTION

In accordance with the present invention, apparatus and methods for reducing toner contamination in electrostatographic reproducing machine are provided. In accordance with the principal aspect of the present invention the apparatus comprises an imaging member having an imaging surface capable of supporting an electrostatic latent image comprising image portions charged to a first polarity and magnitude, and non-image portions of the same polarity but substantially reduced magnitude than said image portions, at least one housing containing means to perform an operation on said imaging surface involving charged toner particles, the housing having at least an exit portion through which air normally flows from the housing to other portions of the machine, the housing being provided at the exit portion with at least one electrode extending across the width of and spaced from the imaging surface, and a means to apply an electrical bias of a polarity and magnitude selected relative to the charge on the imaging surface to create an electrical field barrier in the exit portion sufficient to repel the charged toner particles in the exiting air back into the principal portion of the housing substantially without restricting the air flow from the exit portion.

In a specific aspect of the present invention the electrode is positioned substantially parallel to the imaging surface.

In a further specific aspect of the present invention, the electrode is placed adjacent the lip of a magnetic brush developer housing but outside the development zone, and a magnetic field producing means which forms a brush-like array of charged toner particles is in brushing contact with the electrostatic latent image on the imaging surface to develop that image.

In still a further aspect of the present invention, the electrode is postitioned across the width of the imaging surface and also adjacent the inboard and outboard ends of the developer housing.

In a further aspect of the present invention, the imaging surface and the magnetic brush move in oppposite directions through the development zone and the electrode is positioned adjacent the imaging surface entrance to the developer housing.

In an additional aspect of the present invention, a further nulling electrode, which is electrically insulated from the first electrode and spaced between the first electrode and the imaging surface is provided with a bias of a polarity and magnitude equal to the surface potential of the non-image areas of the imaging surface, whereby the electric field between the imaging surface and the nulling electrode is substantially nullified, thereby minimizing deposition of charged toner particles in said non-image areas.

Another aspect of the present invention relates to electrostatographic reproducing apparatus wherein the imaging surface and a magnetic brush move in the same direction through the development zone, and the electrode is positioned adjacent the imaging surface entrance to the development zone, and mounted to magnetic brush metering means and finally another aspect of the present invention is directed to electrostatographic reproducing apparatus wherein the electrode is positioned adjacent the imaging surface entrance portion to the cleaning housing.

Accordingly it is an object of the present invention to provide method and apparatus for reducing the toner contamination of an electrostatographic reproducing machine.

It is a further object of the present invention to provide a method and apparatus for reducing the amount of toner escaping from a developer housing.

It is an additional object of the present invention to provide a method and apparatus for reducing the amount of toner escaping from a cleaner housing.

It is a further object of the present invention to provide an improved magnetic brush developer housing.

It is a further object of the present invention to provide an electrostatographic reproducing machine which produces copies having more reliable copy quality.

For a better understanding of the invention as well as other objects and further feature thereof, reference is had to the following drawings and description.

BRIEF DESCRIPTION OF THE DRAWINGS

FIG. 1 is a schematic representation in cross section of an automatic electrostatographic reproducing machine with the apparatus and method for reducing toner contamination according to the present invention included therein.

FIG. 5 is a further embodiment of the present invention illustrating the eletrical field barrier which may be created in a typical cleaner housing.

DESCRIPTION OF PREFERRED EMBODIMENT

Figure 2:
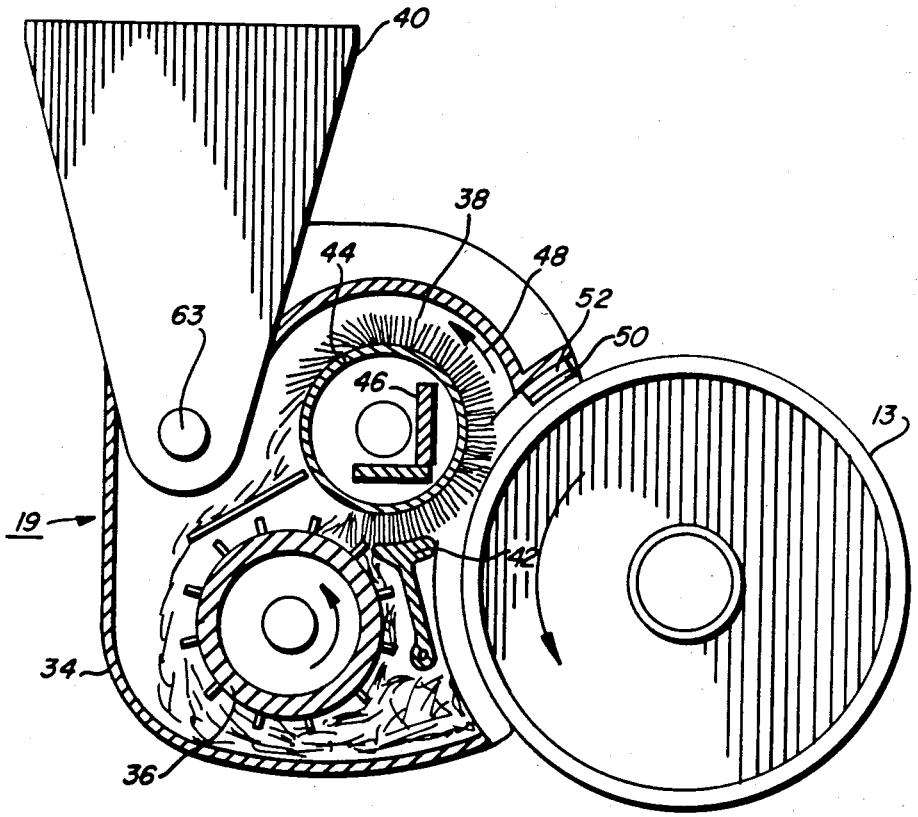
FIG. 2 is an elarged view of the magnetic brush developer housing in an preferred mode of operation according to the present invention wherein the electrode, which repels charged toner particles, is schematically illustrated.

The invention will now be described by reference to a preferred embodiment.

Referring now to FIG. 1 there is shown by way of example an automatic xerographic reproducing machine 10 which includes the toner contamination reduction apparatus of the present invention. The reproducing machine 10 depicted in FIG. 1 illustrates the various components utilized therein for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment or embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17 where an electrostatic charge is placed uniformly over the photoconductive surface 13 in known manner preparatory to imaging. Thereafter, the drum 12 is rotated to exposure station 18 where the charged photoconductive surface 13 is exposed to a light image of the original input scene information whereby the charge is selectively dissipated in the light exposed regions to record the original input scene in the form of an electrostatic latent image. After exposure drum 12 rotates the electrostatic latent image recorded on the photoconductive surface 13 to development station 19 wherein a conventional developer mix is applied to the photoconductive surface of the drum 12 rendering the latent image visible. Typically a suitable development station could include a magnetic brush development system utilizing a magnetizable developer mix having coarse ferromagnetic carrier granules and toner colorant particles.

Sheets 16 of the final support material are supported in a stack arrangement on an elevating stack support tray 20. With the stack at its elevated position a sheet separator feed belt 21 feeds individual sheets therefrom to the registration pinch rolls 22. The sheet is then forwarded to the transfer station 23 in proper registratin with the image on the drum. The developed image on the photoconductive surface 13 is brought into contact with the sheet 16 of final support material within the transfer station 23 and the toner image is transferred from the photoconductive surface 13 to the contacting side of the final support sheet 16. Following transfer of the image the final support material which may be paper, plastic, etc., as desired is transported through detack station where detack corotron 27 uniformly charges the support material to separate it from the drum 12.

After the toner image has been transferred to the sheet of final support material 16 the sheet with the image thereon is advanced to a suitable fuser 24 which coalesces the transferred powder image thereto. After the fusing process the sheet 16 is advanced to a suitable output device such as tray 25.

Although a preponderance of toner powder is transferred to the final suppport material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 26. The toner particles may be mechanically cleaned from the photoconductive surface 13 by any conventional means as, for example, by the use of a rotating brush cleaner.

Normally, when the copier is operated in a conventional mode, the original document to be reproduced is placed image side down upon a horizontal transparent viewing platen 30 and the document is transported past an optical arrangement here illustrated as Selfoc lens 18. The speed of moving platen and the speed of the photoconductive drum are synchronized to provide a faithful reproduction of the original document.

It is believed that the foregoing general description is sufficient for purposes of the present application to illustrate the general operation of an automatic xerographic copier 10 which can embody the apparatus in accordance with the present invention.

Figure 3:
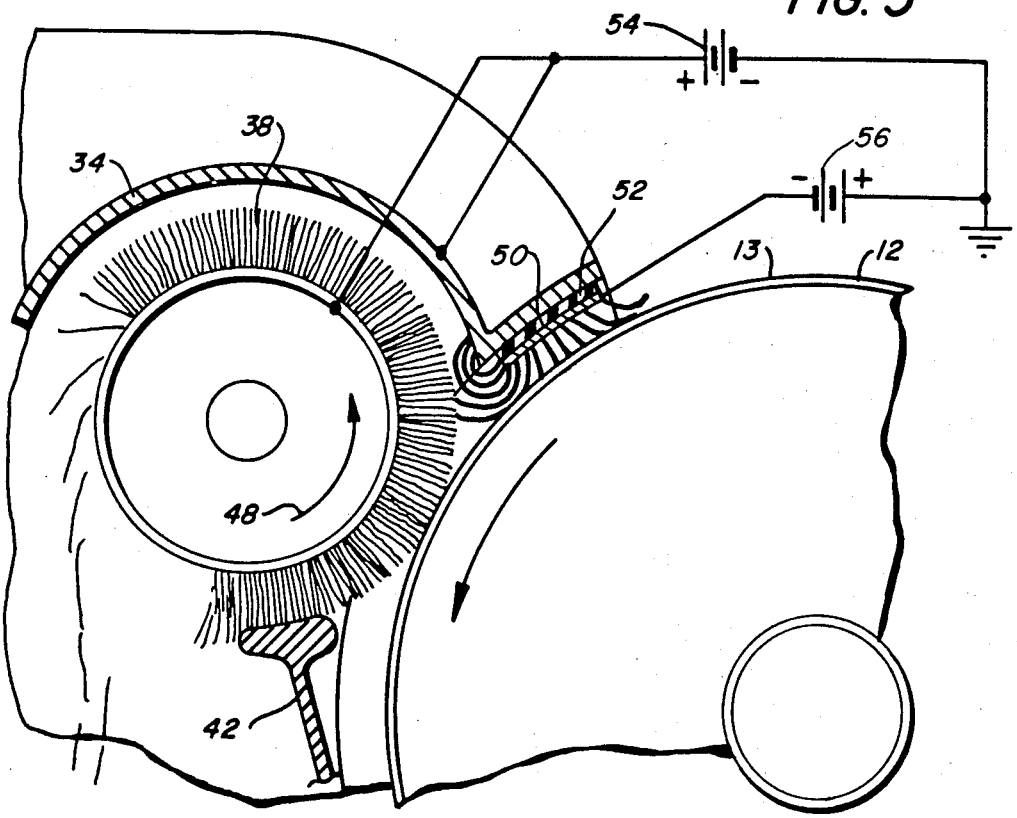
FIG. 3 is also an enlarged view of the magnetic brush developer housing.

Referring more particularly to FIG. 2, wherein a preferred mode of developer housing is illustrated in greater detail, and to FIG. 3 wherein the electrical fields for an electrode according to the present invention are illustrated in greater detail, the primary components of the development system 19 are the developer housing 34, paddle wheel 36, developer roller 38, and toner dispenser 40. Paddle wheel 36 is a cylindrical member with buckets or scoops around the periphery which as it rotates elevates the developer material from the lower region of the housing 34 to the developer roller 38. The magnetic field produced by the fixed magnets in the developer roller 38 attracts the developer material from the supply roll or paddle wheel 36. The developer roller 38 transports the developer material into contact with the electrostatic latent image recorded on the photoconductive surface 13 of drum 12. A surplus of developer material is furnished and metering blade 42 controls the amount of developer material transported into contact with the electrostatic laten image. Preferably developer roller 38 includes a nonmagnetic tubular member 44 having an irregular or roughened exterior surface. Tubular member 44 is journaled for rotation by suitable means such as ball bearing mounts. A shaft assembly is concentrically mounted within tubular member 44 and serves as a fixed mount for magnetic member 46. Tubular member 44 rotates in the direction of arrow 48 which is counter to the direction of rotation of the photoconductive member 13. The toner dispenser 40 includes a container storing a supply of toner particles which are dispensed from the container by a foam roller 63 which rotates. These toner particles mix with the carrier granules to form the developer material which is subsequently advanced by paddle wheel 36 to developer roller 38.

The present invention comprises electrode 50 extending across the width of and longitudinally spaced from the photoconductive drum. The electrode 50 is electrically insulated from the developer housing 34 by insulating plate 52. With continued reference to FIG. 3, wherein the various electrical fields are schematically illustrated by the lines of force, it can be seen that potential sources 56 and 54 respectively are provided for both the gate electrode 50 on the one hand, and the developer housing 34 and the developer roller 38 on the other hand. In a typical embodiment the photoconductive insulating layer 13 is originally charged to a suitable potential of about +800 volts. Following exposure to the light and shadow image of the original document, the image areas remain at about +800 volts with the non-image areas having been discharged to a background level of about +200 volts. Since a positive developed image is desired, the developer is selected so that the individual toner particles are negatively charged and thereby attracted to the positively charged photoconductive layer. With the photoconductive drum and the developer roll rotating in opposite directions within the development zone, i.e., the zone in which there is direct contact between the drum and the magnetic brush bristles, a flow of air with entrained charged toner particles is created which except for the electrode of the present invention would escape from the developer housing at the entrance of the photoconductive drum to the developer housing. While the cause of this air flow is not well understood, it is believed that the moving parts somehow cause the air to flow through an exit. In the context of the present application, the term exit or exit portion is intended to define an opening through which air normally flows out of the housing. With the gate electrode 50 biased to about −600 volts and the developer housing 34, and developer roller 38 both biased to about +volts, an electric field is created and shaped so that there is a strong repulsion of negatively charged toner particles from the gap between the gate electrode 50 and the drum 12 back into the developer housing. In actual practice the electric field is strong enough to repel the vast majority of the negatively charged developer particles which then do not escape from the principal portion of the developer housing through the gap between the electrode and the drum. In this context the term principal portion of the developer housing is intended to define that portion housing the development system such as a magnetic brush in which development of the elecrostatic latent image takes place.

With continued reference to FIG. 3, the electric field may also be further shaped by the biases applied to both the developer housing and the developer roll. In this instance, a strong field exists between both the developer housing and the developer roll relative to the gate electrode which tends to repel toner particles entrained in the air which is exiting the gap between the electrode 50 and the drum. The lines of force illustrated, indicate the general direction in which a toner particle will travel and the negative polarity charge on the electrode acts to repel the negatively charged toner particles away from the electrode 50. In this way an electrostatic barrier may be created and shaped to control the path of the charged toner particles, and repel them back into the developer housing without substantially restricting the air flow from the exit of the developer housing.

Figure 3A:
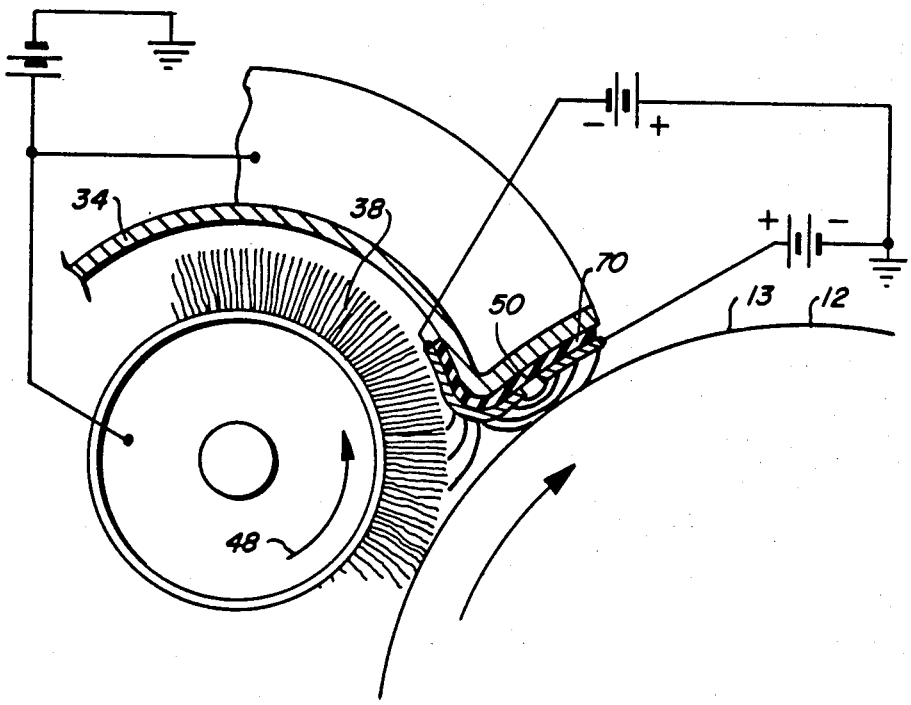
FIG. 3*a* is a modification of FIG. 3 where the photoconductor and magnetic brush are moving in the same direction.

In the embodiment illustrated in FIG. 3, any toner that may deposit in the background areas when that portion of the photoconductor is opposite the electrode 50 is scavenged by the magnetic brush in the development zone so that there is no additional background. If the photoconductive drum illustrated in FIG. 3 were to be rotated in the opposite direction, clockwise, then a nulling electrode 70 in FIG. 3*a* is included opposite the photoconductor and the seal or gate electrode 50 is located further upstream toward the developer housing. In the operation of the system depicted in FIG. 3*a* since the bias on the developer roll and housing is substantially more positive (about +275 volts) than the background of the image (about +100 volts) the electric field lines bend further into the development zone and end on the magnetic brush rather than the photoconductor. Because of the close proximity of the nulling electrode, which is also biased to about +100 volts, the field lines are bent toward the nulling electrode and toner is screened away from the photoconductor.

It will be appreciated if the photoconductor is normally charged negatively that positively charged toner will be used and a positive bias will be applied to electrode 50 with negative bias being applied to the developer housing and the drum. It will also be appreciated that the electrode 50 may be made of any conductive material that may be suitably charged. Bar stock, brass shim stock, and aluminum foil are typically such materials.

Figure 4:
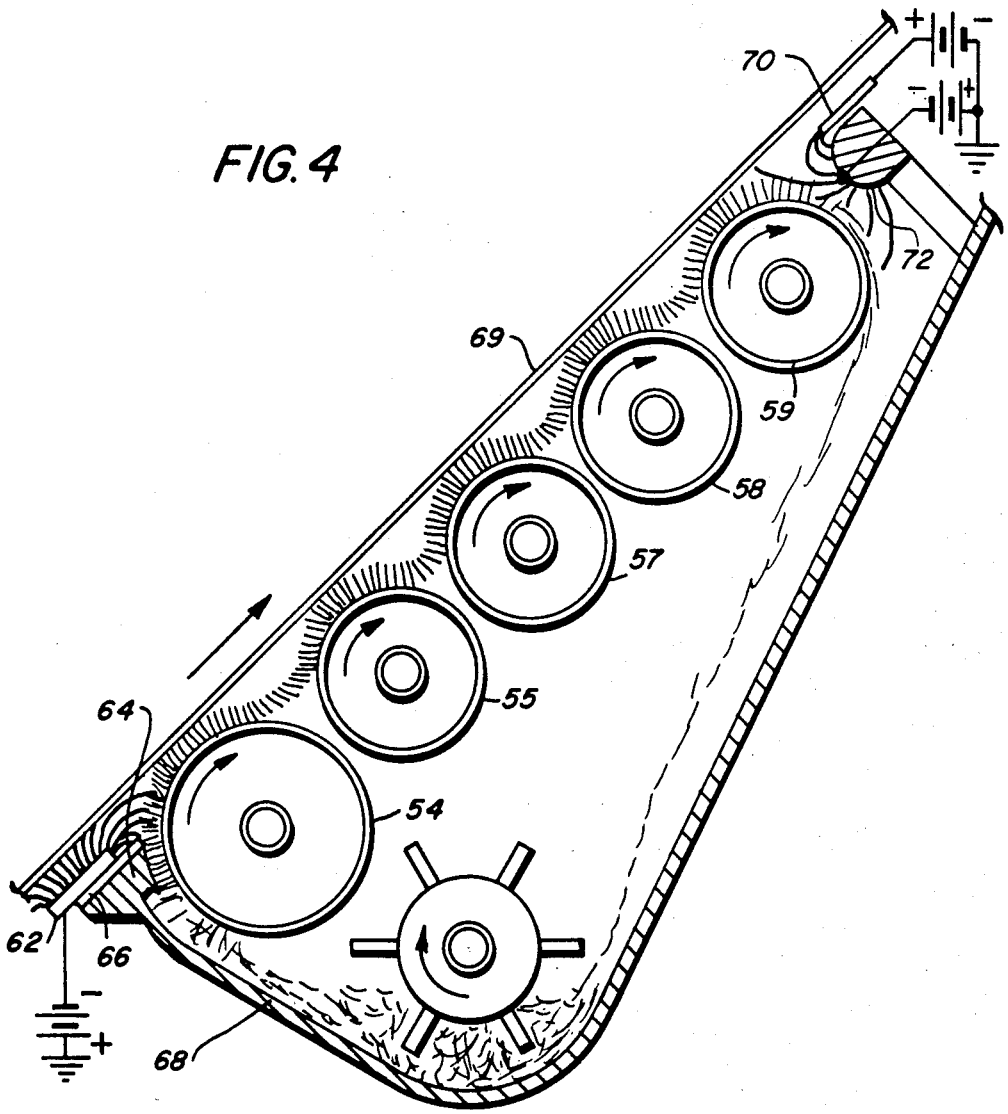
FIG. 4 is an enlarged schematic view of an additional development zone together with the placement of the electrode as well as the nulling electrode according to the present invention.

FIG. 4 illustrates an alternative embodiment wherein electrical field barriers are created at both the photoconductor entrance and exit ends of the development zone. In this embodiment the photoconductor is a belt 69 moving in the same direction as the magnetic brush created by a series of developer rollers 54–59. In the entrance zone the belt has a background potential of +300 volts and the toner is negatively charged. The electrode 62 has a bias of −1000 volts applied to it and is electrically insulated from developer metering blade 64 by insulating plate 66. The developer metering blade 64 may be an integral part of the developer housing. The electrical field created by this arrangement is illustrated in FIG. 4. At the exit portion of the development zone a similar electrical field barrier is created, In this embodiment a nulling electrode 70 is biased to a polarity and charge equal to that in the background areas of the photoconductor, +300 volts, thereby completely nullifying the electrical field when the photoconductor is completely out of the development zone and minimizing the deposition of charged toner particles in the background areas. The electrode 72 has a bias of −600 volts applied to it thereby creating a strong field between the electrode, the photoconductor and the developer roller which tends to repel the negatively changed toner particles from the exit portion of the developer housing while driving them back into the development zone. It should be noted that the nulling electrode is electrically insulated from the gate electrode.

While the advantage of the present invention are readily achieved with its implementation in connection with the developer housing, it also has application to any other operation in an electrostatographic imaging apparatus where charged particles are used. FIG. 5 illustrates the application of the same principle to the cleaning housing wherein a cleaning brush rotating in a direction of the photoconductor 76 may be employed. The cleaning brush dislodges toner particles remaining on the photoconductor after transfer of the developed image to a receiver surface and although there is a vacuum exhaust system small eddy currents may exist at both the photoconductor entrance and exit portion of the cleaner housing. In this embodiment with a background voltage of about +200 volts and an image potential also of about +200 volts on the photoconductor, as a result of being discharged by a pre-clean lamp (not shown), a bias −1000 volts on the electrode 78 and with the cleaner housing grounded, an electrical field barrier as illustrated in FIG. 5 is obtained. It can be seen at both the photoconductor entrance and exit portions that the electrical field is such as to repel toner from exiting either end of the cleaning housing.

Figure 6:
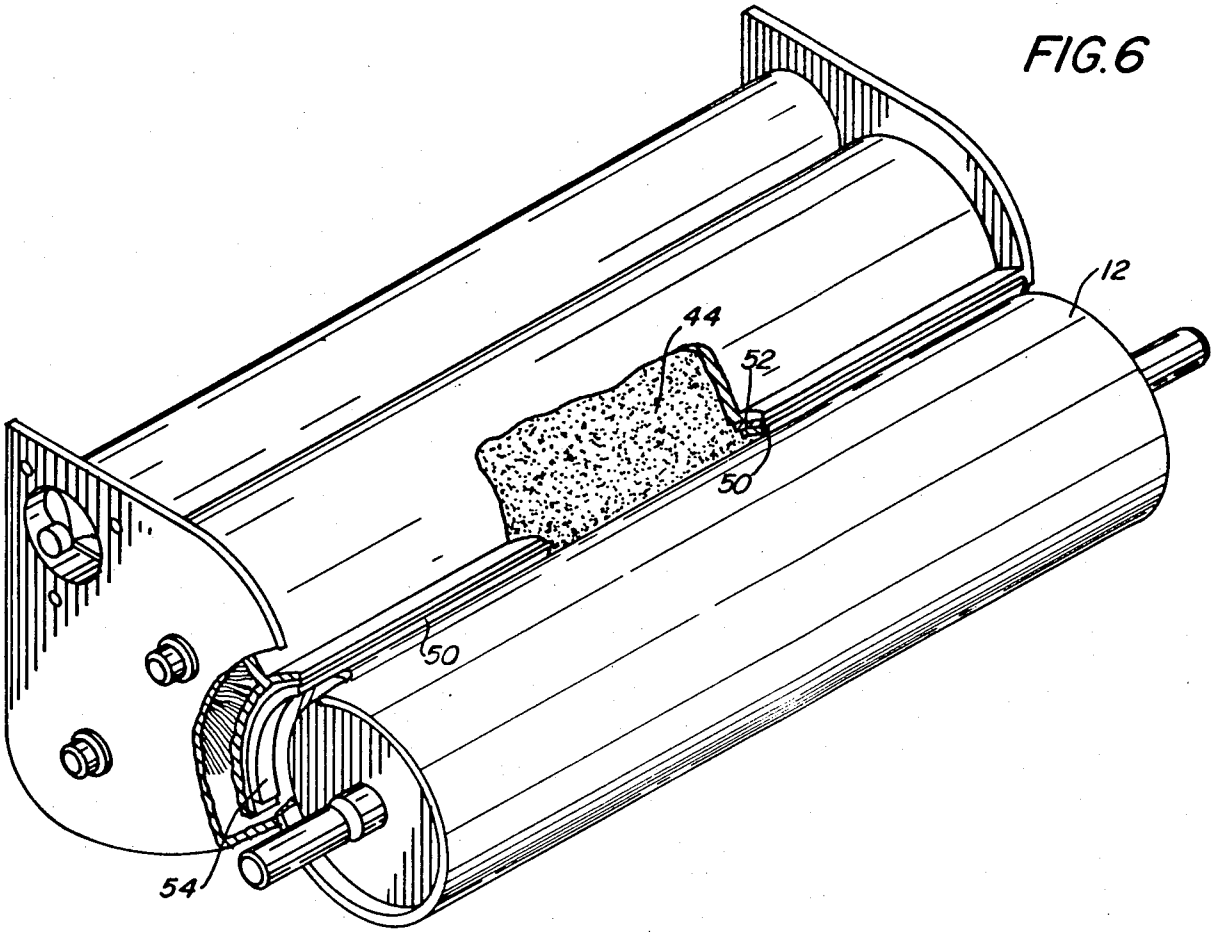
FIG. 6 is an additional embodiment of the present invention illustrating the extension of the electrode to the inboard and outboard ends of the developer housing.

From the above discussion it can be appreciated that the illustrated electrode arrangements can be conveniently placed to provide an electrostatic seal around a chamber in which loose toner particles are charged to some degree, and their paths can be deflected as they travel through the electric field zone. The amount of deflection depends on the electric field strengths and the toner charge magnitudes. Therefore by judiciously placing a set of electrodes with the right polarity applied biases one can electrically filter low velocity air as it leave the source of the entrained toner material. In this manner, toner can be confined to places where it will not contaminate the whole machine, either be reused, scavenged by the developer or periodically cleaned. In achieving this result, the electrode is preferably positioned paralled to the drum and spaced therefrom from about 0.05 centimeters to about 0.70 centimeters. Typically, the electrode to drum spacing is of the order of about 0.3 centimeters all around the surface of the seal. In addition, the seal may also extend around the ends of the developer housing as shown in FIG. 6 where the gate electrode 50 may be shaped or extended along both the inboard and outboard ends 54 of the developer housing to further enlarge the electric field barrier and thereby minimize the escape of charged toner from the ends of the developer housing. This is particularly effective because air flow measurements show that it is here where most of the outward air flow and therefore toner emission occurs. With an arcuate imaging surface such as a photoconductive drum the developer housing has a matched arcuate aperture for the development zone as illustrated in FIGS. 1 and 2 and in this embodiment the electrodes along the ends are also arcuately shaped to conform to the shape of the drum.

While the seal or gate electrode of the present invention may be oriented in a variety of ways it is preferred that it be substantially parallel to and extend across the imaging surface. In this way the strongest electric field may be achieved at the maximum number of points. If the electrode is substantially skewed relative to the imaging surface at the points most remote the electric field drops and the toner repelling ability decreases. As illustrated in FIG. 5, the electrode may also be arcuate in which case it may be a portion of a concentric circle about the axis of the photoconductive drum.

The above described gate electrode and nulling electrode combination therewith have the advantage of economy of construction. Through the use of the gate electrode alone, the toner contamination of electrostatographic reproducing machines may be substantially reduced. In particular, significant improvement may be had in a magnetic brush development housing employing such a device. In summary, the apparatus and method according to the present invention provide for maintaining copy quality, and reduced frequency of necessary maintenance to automatic reproducing machines employing same.

While the above invention has been described with reference to specific embodiments, it will be apparent to those skilled in the art that many alternatives, modifications and variations may be made. For example, while the invention has been described in one embodiment with reference to a brush cleaning apparatus, the principal will work equally well in a cleaning apparatus which employs a cleaning blade. Accordingly, it is intended to embrace all such alternatives and modifications as may fall within the spirit and scope of the appended claims.

I claim:

1. An electrostatographic reproducing apparatus comprising an imaging member having an imaging surface capable of supporting an electrostatic latent image comprising image portions of a first charge polarity and magnitude and non-image portions of the same polarity and substantially less magnitude than said image portions, a developer housing comprising an open ended chamber for storing toner particles charged to a polarity opposite said first polarity, said chamber containing magnetic field producing means mounted internally and positioned closely adjacent said imaging surface, said magnetic field producing means forming a brush like array of charged toner particles extending outwardly from the open end of the chamber of said developer housing in brushing contact in the same direction with the electrostatic latent image on said imaging surface to form an electrostatic latent image development zone, said developer housing having an exit portion at the imaging surface exit to the development zone through which air normally flows from the housing to other portions of the machine, said developer housing being provided at said exit portion with at least one electrode electrically insulated therefrom and extending across the width of and spaced from the imaging surface, means to apply an electrical bias to said electrode of a polarity and magnitude selected relative to the charge on the imaging surface to create an electrical field barrier in said exit portion sufficient to repel the charged toner particles in the exiting air back into the principal portion of the developer housing substantially without restricting the air flow from said exit portion, means to apply an electrical bias to said developer housing of a polarity and magnitude to create an electrical field between said electrode and said developer housing which repels charged toner particles back into the principal portion of the developer housing, and a nulling electrode electrically insulated from said first electrode and space between said first electrode and said imaging surface and further including means to bias said nulling electrode to a polarity and magnitude equal to the non-image areas on said imaging surface whereby the electric field between said imaging surface and said nulling electrode is substantially nullified thereby minimizing deposition of charged toner particles in said non-image areas.

* * * * *